United States Patent [19]

Smith, Jr. et al.

[11] 4,126,027

[45] Nov. 21, 1978

[54] METHOD AND APPARATUS FOR ECCENTRICITY CORRECTION IN A ROLLING MILL

[75] Inventors: Andrew W. Smith, Jr., Mt. Lebanon; Kenneth S. Kratz, Murrysville, both of Pa.

[73] Assignee: Westinghouse Electric Corp., Pittsburgh, Pa.

[21] Appl. No.: 803,195

[22] Filed: Jun. 3, 1977

[51] Int. Cl.[2] ..... B21B 37/00

[52] U.S. Cl. ..... 72/11; 72/21

[58] Field of Search ..... 72/21, 19, 8–12

[56] References Cited

U.S. PATENT DOCUMENTS

| | | | |
|---|---|---|---|
| 3,881,335 | 5/1975 | Cook | 72/11 |
| 3,882,705 | 5/1975 | Fox | 72/11 |

*Primary Examiner*—Milton S. Mehr

*Attorney, Agent, or Firm*—R. G. Brodahl; J. J. Wood

[57] ABSTRACT

A method and apparatus is disclosed for eccentricity correction in a rolling mill, in which prior to rolling, the eccentricity of the back-up rolls is measured and recorded both initially and each time the back-up rolls are changed. In an analog loop, constant roll gap is maintained by bidirectionally displacing the back-up rolls so as to maintain constant roll force in accordance with a reference roll force signal, the displacements being such as to neutralize the measured and recorded eccentricity. In a digital feedback loop, controlled by a digital computer, roll force is maintained constant in accordance with changes in the gauge of the work product, with the displacement of the back-up rolls producing a change in roll opening. The analog and digital control loops are cooperatively combined, so that the change in roll opening resulting from digital control, produces a new roll force reference for the analog loop. Effectively then, the intercooperation of analog and digital loops simultaneously produces roll eccentricity and gauge change compensation.

8 Claims, 7 Drawing Figures

TABLE ORGANIZATION
ROLL ECCENTRICITY COMPENSATION

| DATA TABLE INDEX | ANGULAR POSITION IN DEGREES | TAB1 | TAB2 | TRE | BRE |
|---|---|---|---|---|---|
| 1 | 1 → 10 | | | | |
| 2 | 11 → 20 | | | | |
| 3 | 21 → 30 | | | | |
| ↓ | ↓ | | | | |
| 36 | 351 → 360 | | | | |

RELATIONSHIPS: (1) $TRE(I) = \frac{1}{2}\left[TAB1(I) + TAB2(I)\right] - AVERAGE$ (2) $BRE(I) = \frac{1}{2}\left[TAB1(I) - TRE(I)\right]$

METHOD AND APPARATUS FOR ECCENTRICITY CORRECTION IN A ROLLING MILL

BACKGROUND OF THE INVENTION

1. Field of the Invention

This invention relates to a method and apparatus for eccentricity correction in a rolling mill system.

2. Description of the Prior Art

In hot and cold rolling mills the eccentricity of the back-up rolls results in a major problem, in that, if uncorrected this will cause a change in the exit gauge of the product being rolled. As a result of this eccentricity, as the back-up rolls are displaced, they present a variable opening to the workpiece being processed.

Most rolling mills today utilize an automatic gauge control (AGC) which is a vernier trimming control added to the basic mill control system in order to compensate for delivered gauge variations. A mill is initially set up as near as can be predicted, to run a given schedule to produce the desired gauge. The AGC system then takes over while the strip is being rolled to monitor and correct for initial gauge errors as well as those occurring during rolling. The AGC utilizes a roll force signal from a load cell, associated with the rolls to be monitored, as an indication of gauge variation. As the gauge increases, or a harder surface is presented at the roll opening, this causes an increase in the roll separating force. The AGC senses this increase in roll force, and signals for the rectilinear displacement of the rolls in such direction as to increase the roll force further to reestablish the proper gauge. The reverse occurs if the gauge or thickness decreases or softer material is presented to the rolls.

Eccentricity of the back-up rolls produces a periodic increase and decrease in the roll force as the rolls rotate. When eccentricity causes an increase in roll force, without compensation, the AGC would interpret this as an increase in gauge (the opposite is true) or hardness, and signal for an increase in roll force, which compounds the error making it worse than if due to eccentricity alone. The reverse obtains when eccentricity causes a decrease in gauge.

These considerations are well known in the art and various corrective techniques have been offered. It has been proposed to give the AGC a deadband greater than the gauge error caused by the back-up roll eccentricity. Another solution teaches simulating back-up roll eccentricity with a mechanical cam having a contoured surface corresponding to that eccentricity, and then feeding the simulated eccentricity to the AGC as a correction signal.

The closest known prior art to the instant invention is described in U.S. Pat. No. 3,882,705 for "Roll Eccentricity Correction System and Method," by Richard Q. Fox and assigned to the same assignee as the present invention. In this patent, the eccentricity of each back-up roll is measured and recorded during calibration in order to monitor the rotation of these rolls during the rolling process, and to correct the roll force gauge control equation to dynamically compensate for the eccentricity of the rolls.

SUMMARY OF THE INVENTION

The present invention provides a method and apparatus for controlling the delivery gauge or gauge of a workpiece passing through a rolling mill stand having at least one pair of back-up rolls. The magnitudes of the eccentricities of the back-up rolls are measured and retained. A first means maintains a constant roll gap at the work rolls if there is no change in the gauge of the workpiece, by keeping the roll force constant in accordance with a reference roll force. Assuming no eccentricity another means maintains constant roll force by bidirectionally displacing the back-up rolls with concomitant change in the roll gap When eccentricity and gauge change occur simultaneously, by superposition, the constant roll force means modifies the operation of the constant roll gap means by producing a new reference roll force in response to said concomitant change in roll gap

GENERAL DESCRIPTION OF THE GAUGE CONTROL SYSTEM AND ITS OPERATION

Figure 1:
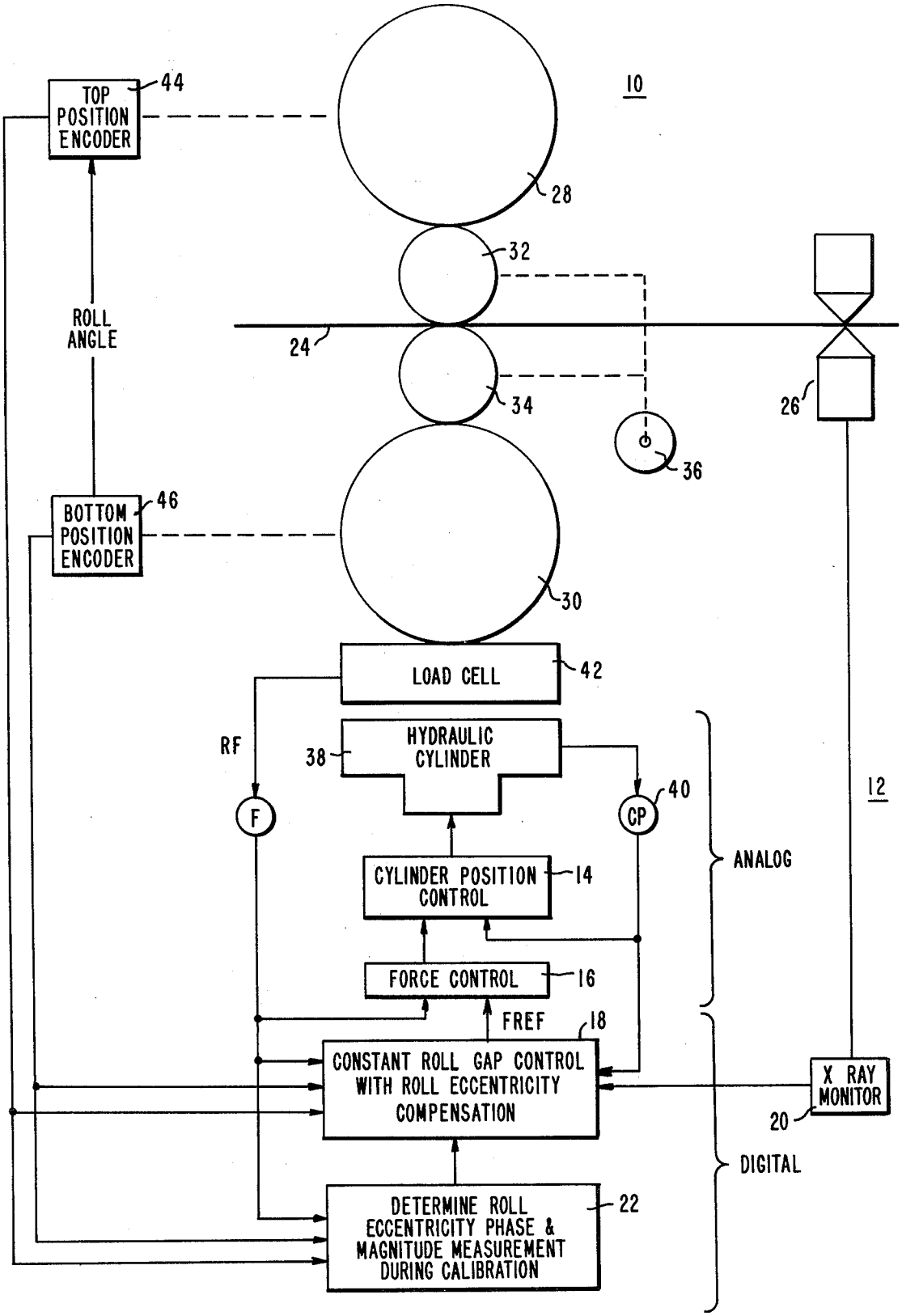
FIG. 1 shows a schematic diagram of a roll stand and a gauge control system arranged for operation in accordance with the present invention.

The present invention provides an improvement on the teachings of the patent to Fox cited supra. In contemplation of this patent, the roll gap in a rolling system is dynamically changed after a computer has made calculations based upon the known eccentricites of the backup rolls and either changes in gauge or changes in hardness of the material being rolled or both. The computer, despite its admitted advantages in handling large amounts of data, nevertheless takes a finite time to perform these calculations. At slower mill speeds this finite time lapse is of no importance, but in faster running mills such a time lag may be detrimental.

The instant invention proposes to use analog and digital computer techniques to perform the required corrections. The change in eccentricity of the work rolls is immediately compensated for by a fast acting analog loop which maintains the roll force constant in accordance with a force reference signal, thus neutralizing the off gauge changes due to eccentricity. The analog loop will also respond to changes in gauge or hardness. The computer portion of the system monitors and records the eccentricity of the back-up rolls as taught by Fox. However, it now also monitors the analog loop for changes in the roll force. Since the digital computer has stored the location of the eccentricities (in terms of angular displacement), it sends out a signal to correct the force reference signal when the disturbances are due to change in gauge or hardness, and it maintains the status quo when the perturbations are due to eccentricity alone.

Thus, the present invention corrects for the perturbations due to eccentricity which are periodic and of short duration, in a fast analog loop, while changes in gauge or hardness, which most likely represent a trend of longer duration, are handled by the digital computer loop.

In rolling systems, the prime mover for vertical rectilinear displacement of the back-up rolls may be either an electromechanical screw-down positional control or an electrohydraulic positional control in which the back-up rolls are displaced by hydraulic cylinders. The invention will be illustrated in a rolling mill system using electrohydraulic means for actuation of the back-up rolls.

Briefly, the roll force gauge control system utilizes the principles of Hooke's law in controlling the cylinder position at a rolling stand, i.e., the loaded roll opening under workpiece rolling conditions equals the unloaded roll opening or cylinder position plus the mill spring stretch caused by the separating force exerted on the rolls by the workpiece. In a practical embodiment of this rolling principle in a roll force gauge control system, a load cell or other force detector measures the roll separating force at each controlled roll stand and the cylinder position is controlled to balance roll force changes from a reference value and thereby hold the loaded roll opening at a substantially constant value. Typically, the roll force gauge control system responds to the roll force signal F and the cylinder position CP to hold the following equality:

$$\Delta CP = -\Delta FK \quad (1)$$

where:

$\Delta F$ = measured change in roll force from an initial force $\Delta CP$ = controlled change in cylinder position from an initial cylinder position $K$ = predetermined mill stand spring modulus After the unloaded roll opening setup and the stand speed setup are determined by the mill operator for a particular workpiece pass or series of passes, the rolling operation is begun and the cylinder positions are controlled to regulate the workpiece delivery gauge from the reversing mill stand or from each roll force controlled tandem mill stand, such that the loaded roll opening is maintained constant or nearly constant.

As the head end of the workpiece strip enters each roll stand of the mill, the lock-on cylinder position and the lock-on roll separating force are measured to establish what strip gauge should be maintained out of that roll stand. As the strip rolling operation proceeds, the roll stand separating force and the roll stand cylinder position values are monitored and any undesired change in roll separating force is detected and compensated for by a corresponding correction change in cylinder position. The lock-on gauge LOG is equal to the lock-on cylinder LOCP plus the lock-on force LOF multiplied by the mill stand spring modulus K. The workpiece strip delivery gauge G leaving the roll stand at any time during the rolling operation is equal to the unloaded cylinder position CP plus the roll separating force F multiplied by the mill spring modulus K. The gauge error is derived by subtracting the lock-on gauge from the delivery gauge. The following Equations 2, 3 and 4 set forth these relationships.

$$LOG = LOCP + K^{*}LOF \quad (2)$$

$$G = CP + K^{*}F \quad (3)$$

$$G - LOG = \text{GAUGE ERROR} = CP - LOCP + (F - LOF)^{*}K \quad (4)$$

A background teaching of stored program digital computer system operation can be found in the text "Electronic Digital Systems" by R. K. Richards, published in 1966 by John Wiley and Sons.

A detailed description of computer programming techniques in relation to the control of metal rolling mills can be found in an article in the Iron and Steel Engineer Yearbook for 1966 at pages 328 through 334 entitled "Computer Program Organization For An Automatically Controlled Rolling Mill" by John S. Deliyannides and A. H. Green, and in another article in the Westinghouse Engineer for January 1965 at pages 13 through 19 and entitled "Programming For Process Control" by P. E. Lego.

Referring now to FIG. 1 there is disclosed a four high rolling mill stand 10 operative with a gauge control system indicated generally at 12 and comprising, a cylinder positioning control 14, force control 16, constant roll gap control 18, and X-ray monitor 20 in accordance with the principles of the present invention. The phase and magnitude of the roll eccentricity is determined by measurement 22 during calibration. Generally, the invention is applicable to various types of rolling mill stands in which roll force gauge control is employed. Thus, the invention can be suitable adapted for application in hot steel plate, reversing rolling mills.

A workpiece 24 enters the roll stand 10 at the entry end and it is reduced in thickness as it is transported through one or more roll stands to the delivery end of the rolling mill. The entry workpiece would be of known steel grade and it typically would have a known gauge or thickness. The delivered workpiece would have a desired thickness as measured by the X-ray gauge 26 based upon the production order for which it is intended.

In the reduction rolling process, the one or more roll stands operate at successively higher speeds to maintain proper workpiece mass flow. Each stand produces a predetermined reduction or draft such that the total mill draft reduces the entry workpiece to a strip with the desired gauge or thickness.

Each stand is conventionally provided with a pair of back-up rolls 28 and 30 and a pair of work rolls 32 and 34 between which the workpiece 24 is passed. A large DC drive motor 36 is controllably energized at each stand to drive the corresponding work rolls at a controlled speed.

As previously described, the sum of the unloaded work roll opening and the mill stretch substantially defines the workpiece gauge delivered from any particular stand in accordance with Hooke's law. In order to vary the unloaded work roll opening at each stand, a pair of hydraulic cylinders 38 (only one is shown for the roll stand) which clamp against opposite ends of the back-up rolls, and thereby apply pressure to the work rolls. It should be understood that the hydraulic cylinders 38 are merely illustrative of roll opening positioning devices, and well known screw-down motors could be used but with a slower response to gauge error. A conventional cylinder position detector or encoder 40 provides an electrical signal representation of screw-down position.

Roll force detection is provided at the roll stand 10 by a conventional load cell 42 which generates an electrical signal proportional to the roll separating force between the work rolls 32 and 34. At the very least, for a tandem rolling mill, each roll force controlled stand is provided with a load cell 42 and in many cases stands without roll force gauge control would also be equipped with load cells. The number of stands to which roll force gauge control is applied is predetermined during the mill design in accordance with cost performance standards, and increasingly there is a tendency to apply roll force gauge control to all of the stands in a tandem hot strip steel mill.

It is preferred that the cylinder position control 14 and the force control 16 include well known and conventional fast response analog controls such as operational amplifiers. The constant roll gap control 18, X-ray monitor 20 and the roll eccentricity measurement 22 can include a programmed general purpose control digital computer system, which is interfaced with various mill sensors and various mill control devices to provide control for the mill stand 10.

On the basis of these considerations, a suitable digital computer system for the on-line constant roll gap control would be a W2500 made and sold by Westinghouse Electric Corporation. A descriptive book entitled 2500 Computer Systems Reference Manual has been published in 1971 by Westinghouse Electric Corporation and made available for the purpose of describing in greater detail this computer system and its operation.

The digital computer system is associated with well known predetermined input systems, typically including a conventional contact closure input system which scans contact or other signals representing the sensed status of various process conditions, a conventional analog input system which scans and converts process analog signals, and operator controlled and other information input devices and systems such as paper tape, teletypewriter and dial input systems. Various kinds of information can be entered into the computer system through the input devices including, for example, desired strip delivery gauge and temperature, strip entry gauge and width and temperature (by entry detectors if desired), grade of steel being rolled, plasticity tables, hardware oriented programs and control programs for programming system, and so forth. The contact closure input systems and the analog input systems interface the computer system with the process through the medium of measured or detected variables, which include the following:

1. A roll force signal from the load cell 42 at the roll stand 10 proportional to stand roll separating force for use in roll force gauge control.

2. Roll opening (cylinder position) signal generated by the respective cylinder position detector 40 for use in roll force gauge control.

3. A position signal from rotary transducer or pulse generator 44 in relation to the angle of rotation of the top back-up roll 28.

4. A position signal from rotary transducer or pulse generator 46 in relation to the angle of rotation of the bottom back-up roll 30.

It is noted at this point in the description, that the measured stand roll force and the measured stand roll opening position in relation to the workpiece head end are stored and used as references for roll force gauge control system functioning if it is desired to operate in the well known lock-on mode of roll force gauge control operation.

To effect determined output control actions, controlled devices are operated directly by means of output system contact closures or by means of analog signals derived from output system contact closures through a digital to analog converter.

The principal control action output from the constant roll gap control 18 is a roll force signal applied to the force control 16 that, in turn, provides the reference to the cylinder position control 14 to move the cylinder to provide the desired roll gap.

Display and printout systems such as numeral display, tape punch, and teletypewriter systems can be also associated with the outputs of the digital computer system in order to keep the mill operator generally informed about the mill operation and in order to signal the operator regarding an event or alarm condition which may require some action on his part.

Generally, constant roll gap control 18 uses Hooke's law to determine the total amount of roll force change required at the stand 10 at the calculating point in time for roll force and gauge error correction, i.e. for loaded roll opening and stand delivery gauge correction to the desired value. The calculation defines the total change in the roll force required to correct for roll force and gauge error causing conditions with roll eccentricity compensation.

Figures 2, 7:
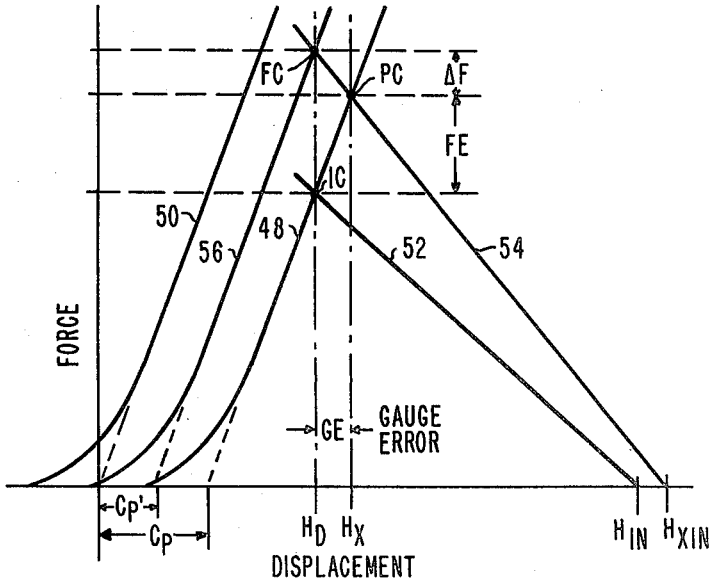
FIG. 2 illustrates a mill spring curve and a workpiece reduction curve for a rolling mill stand, and the determination of a roll force screw-down correction in relation to a change in the stand load force.
FIG. 7 is a diagram used in explaining the operation of the FIG. 4 embodiment.

In FIG. 2, curves are shown to illustrate the application of Hooke's law to a rolling mill stand and to illustrate the basis upon which the constant roll gap control 18 provides improved roll force gauge control. A mill spring curve 48 defines the separation between a pair of mill stand work rolls as a function of roll separating force and as a function of screw down position. The slope of the mill spring curve 48 is the well known mill spring constant K. When a correct cylinder calibration is known and the cylinder is positioned such that the empty work rolls are just facing, the unloaded cylinder zero position is defined. The zero cylinder location mill spring curve is indicated by the reference character 50.

At the correct calibration condition, the indicated theoretical face intersect represents theoretical roll facing and it is for this theoretical condition that the cylinder position is assigned to a zero value. Under the correct calibration condition, roll facing actually occurs when the cylinder position is at a slightly negative value because of the non-linearity of the lower part of the mill spring curve. A definition of the cylinder calibration as being correct for the indicated theoretical conditions is, however, convenient and appropriate for mill operation.

When the cylinder is opened (positive movement) the unloaded roll opening increases as reflected by a change to the right in the graphical location of the mill spring curve 48 such that the theoretical spring curve intersect equals the new unloaded roll opening. With cylinder closing, the mill spring curve 48 is shifted to the left in a similar manner.

At any particular cylinder position and with the correct cylinder calibration, the stand workpiece delivery gauge equals the unloaded roll opening as defined by the cylinder position CP plus the mill stretch caused by the workpiece. If the cylinder calibration is incorrect, i.e. if the number assigned to the theoretical roll facing cylinder position is something other than zero because of roll crown wear or other causes, the stand workpiece delivery gauge equals the unloaded roll opening plus the mill stretch plus or minus the calibration drift.

The amount of mill stretch depends on the characteristic reduction curve for the workpiece. As shown in FIG. 2, a reduction curve 52 for a workpiece strip of predetermined width represents the amount of force required to reduce the workpiece from a stand entry thickness (height) of $H_{IN}$. The workpiece plasticity P is the slope of the curve 52, and in this case the curve 52 is shown as being linear although a small amount of non-linearity would normally exist.

Desired workpiece delivery gauge $H_D$ is the initial condition IC produced in this case since the amount of force required to reduce the workpiece from $H_{IN}$ to $H_D$ is equal to the amount of roll separating force required to stretch the rolls to a loaded roll opening $H_D$, i.e. the intersection of the mill spring curve at an initial cylinder opening CP indicated by mill spring curve 48 and the workpiece reduction curve 52 lies at the desired gauge value.

As shown in FIG. 2, if the stand delivery gauge increases by a gauge error amount GE to $H_X$ during a workpiece pass to produce a present condition PC, in this instance because the workpiece plasticity decreases and because the workpiece entry thickness increases to $H_{XIN}$ as represented by the reduction curve 54, the stand force must be increased to a value which causes a future correct gauge condition FC. At the condition FC, the intersection of the mill spring curve and the new reduction curve 54 lies at the desired gauge $H_D$ as provided by a spring curve location indicated by the reference character 56. In other words, corrective cylinder closing causes the roll force to be increased by $\Delta F$ to a new value which adds with the new mill stretch to equal the desired gauge $H_D$.

$$\Delta F = \text{GAUGE ERROR}/P \tag{5}$$

where

GAUGE ERROR is obtained from equation (4) and $P$ = workpiece plasticity

Generally the operative value of each stand spring constant K is relatively accurately known. It is the first determined by the conventional work roll cylinder test, and it can be recalculated prior to each workpiece pass on the basis of the workpiece width and the back-up roll diameter. Each resultant spring curve is stored for on line gauge control use.

The operative value of the workpiece plasticity P at each stand is also relatively accurately determined. If desired, P tables can be stored in the storage memory of the digital computer system associated with the constant roll gap control 18 shown in FIG. 1 to identify the various values of P which apply to the mill stand 10 for various grade class and gauge class workpieces under various operating conditions and at various operating times during the rolling of the workpiece strip 24.

A main advantage of using the roll force gauge control system is the ability to detect error changes in strip gauge the instant they take place as the product is being rolled in the roll stand. A shift in strip delivery gauge or thickness can be caused by a change in entry thickness, or a change in hardness as usually caused by a change in temperature. This change in delivery gauge can be immediately detected by feedback information monitoring of the roll separating force on the roll stand.

The force correction $\Delta F_{RF}$ can be determined by the relationship of equation (5).

DESCRIPTION OF BACK-UP ROLL ECCENTRICITY CORRECTION

The measurement of the back-up roll eccentricity can be done any time that is desired by the operator when there is not a workpiece strip in a stand. The hardware required consists of a force measuring load cell operative with the stand, and rotary transducers operative with each back-up roll. An analog or digital computer can be used to implement the required calculations.

The eccentricity measurement is accomplished by facing the work rolls 32 and 34 shown in FIG. 1 to a predetermined force and rotating them at a typical operating speed. The rotary transducers 44 and 46 will respectively indicate the exact position of each back-up roll as it rotates, and the load cell 42 will indicate the force fluctuations caused by the eccentricity of the back-up rolls. The control system in the first step records the force reading F for every few degrees of rotation of the back-up rolls. Mathematically this force reading is in accordance with the following equation:

$$\text{Force}_1 = \text{Average Force} + (A^*\sin\theta) + B^*\sin(\theta + C) \tag{6}$$

where:

$\theta$ is the angle of rotation of the top back-up roll.

$A$ is the maximum force component caused by the eccentricity of the top back-up roll, and $B$ is the maximum force component caused by the eccentricity of the bottom back-up roll.

$C$ is the angular offset between the top and bottom back-up roll eccentric axes.

Since the back-up rolls are not physically coupled to each other, and are never the same diameter, they are not actually rotating at the same frequency but the above equation is valid over short periods of time.

The second step is to allow the back-up rolls to rotate until the slight difference in rotational frequency has caused the bottom roll to be 180° offset from its initial relationship to the top roll. The equation for this condition would be:

$$\text{Force}_2 = \text{Average Force} + (A^*\sin\theta) + B^*\sin(\theta + C + 180°) \tag{7}$$

The rotary transducers 44 and 46 can each be monitored to detect when this condition has occurred, and the control system 12 would then record the force reading for every predetermined number of degrees of rotation of the back-up rolls.

The control system 12 now has enough information to permit the determination of the eccentricity of the top and bottom back-up rolls. The eccentricity of the bottom roll is determined as follows:

$$\text{Force}_1 - \text{Force}_2 = 2B^*\sin(\theta + C) \tag{8}$$

$$B^*\sin(\theta + C) = \frac{\text{Force}_1 - \text{Force}_2}{2} \tag{8}$$

$$\text{Eccentricity}_B = B^*\sin(\theta + C)^*\text{mill spring} \tag{10}$$

$$E_B = \frac{F_1 - F_2}{2} * K \tag{11}$$

In other words, if the calibration 22 subtracts the data of the $\text{Force}_2$ measurements from the data of the $\text{Force}_1$ measurements, and divides by 2, it has a record of the force components of the bottom roll for every few degrees of rotation, as desired in relation to selected values of the angle $\theta$, and this force component is proportional to the eccentricity of the bottom roll.

The eccentricity of the top roll is determined as follows:

$$A^*\sin\theta = \text{Force}_1 - \text{Average Force} - B^*\sin(\theta+C) \quad (12)$$

$$\text{Eccentricity}_T = A^*(\sin\theta)^* \text{ mill spring} \quad (13)$$

where Average Force is the integral from 0° to 360° of the measured values of $F_1$ and divided by the number of samples as follows:

$$\text{Average Force} = F_{av} = \frac{\sum_{0^\circ}^{360^\circ} \text{Force}/}{\text{Number of Samples}} \quad (14)$$

$$A^*\sin\theta = F_1 - B^*\sin(\theta+C) - F_{av} \quad (15)$$

$$A^*\sin\theta = F_1 - \left(\frac{F_1 - F_2}{2}\right) - F_{av} \quad (16)$$

$$A^*\sin\theta = \frac{(F_1 + F_2)}{2} - F_{av} \quad (17)$$

$$E_T = \left[\frac{F_1 + F_2}{2} - F_{av}\right]^*K \quad (18)$$

The above equations allow the control system to utilize the recorded data to provide a record of the force components of the top roll for selected values of the angle $\theta$ in degrees of rotation.

The next step is to apply this information to the above roll force gauge control equation 4 for the workpiece gauge control as follows:

Gauge Error = (Cylinder Position - Lock-on Cylinder Position) + Eccentricity of top roll + eccentricity of bottom roll + (Force-Lock-on Force) * mill spring. (19)

Where the eccentricity correction is a function of the angular position of each of the back-up rolls, and the angular positions are measured by the respective rotary transducers 44 and 46, this revised equation responds properly to roll eccentricity. When eccentricity causes the roll gap to close, the equation accounts for this, and when the measured roll force increases as a result of the eccentricity, the equation indicates the true gauge error.

If the above roll force gauge control equation is implemented in an analog automatic gauge control instead of a digital AGC, a digital computer can be used if desired to output an analog signal to the analog AGC corresponding to each value of eccentricity.

The equations for $\text{Force}_1$ and $\text{Force}_2$ assume that the eccentricity is sinusoidal, for simplicity. However, the true eccentricity can actually be modeled by the sum of a number of sinusoidal terms of different amplitudes and different phases but common frequency, therefore, the results derived from the equations would still be true. The operator initially faces the rolls to a high force and rotates them. The signals supplied to the control system are the roll force signal from the load cell and the pulse signals from the pulse generator coupled to the upper back-up roll to indicate the rotational position of the upper roll and the pulse signals from the pulse generator coupled to the lower back-up roll to indicate the rotational position of the lower roll. The gauge control system is programmed to sample the force signal over one complete rotation of the upper and lower back-up rolls; for theoretical purposes only one complete rotation is needed but in actual practice for mechanical purposes the force signal for four or five rotations of the back-up rolls is sampled to provide statistical averages. The control system is programmed to sample the force signal and save a predetermined number such as 90 samples in memory, with one sample being made for each 4° of rotation of the upper back-up roll, and in this way obtain roll force samples in memory for the rotation angle of the top back-up roll $\theta$ going from 0° to 360°, with no workpiece positioned between the work rolls and with a predetermined roll force such as 1000 metric tons being provided for the roll stand under consideration. The second step of measuring the back-up roll eccentricity is to separate the work rolls and rotate one of the back-up rolls, for example the bottom back-up roll, until the pulse generator operative with the bottom back-up roll indicates that the bottom back-up roll is now rotated substantially 180° from its relationship to the top back-up roll to in effect provide a 180° phase shift of the bottom back-up roll, and then again sample the roll force signal for each 4° of rotation of a complete 360° rotation of the top back-up roll and save in memory the resulting 90 roll force signal samples. These roll force signal measurements are all made with respect to the top back-up roll rotational position as a reference.

The back-up roll caused error in the measured roll force signal for a given rolling mill roll stand can be in the order of ± 10% of the desired delivery gauge, particularly in relation to the last roll stand of a rolling mill. For a rolling mill stand with hydraulic roll positioning apparatus, the speed of response is fast enough to actually remove the eccentricity impressions by changing the roll opening in phase with the eccentricity as required to correct the gauge error resulting from the eccentricity of either one or both of the back-up rolls.

Figure 3:
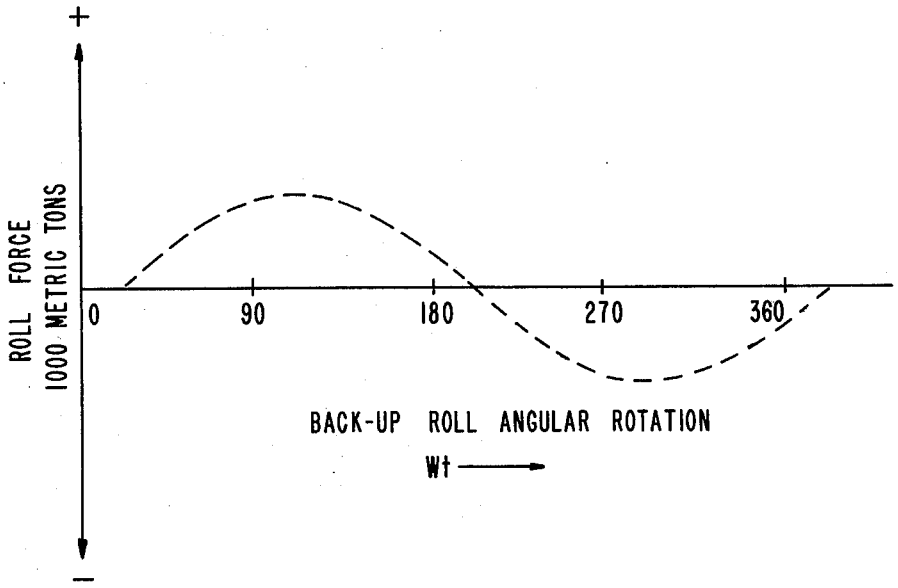
FIG. 3 shows an illustrative example of the roll force disturbance caused by back-up roll eccentricity.

In FIG. 3 there is illustrated the eccentricity correction to be applied to the roll opening of the mill stand in relation to the angular rotation position of a particular back-up roll. The roll force error caused by the back-up roll eccentricity is shown by the curve.

Figure 4:
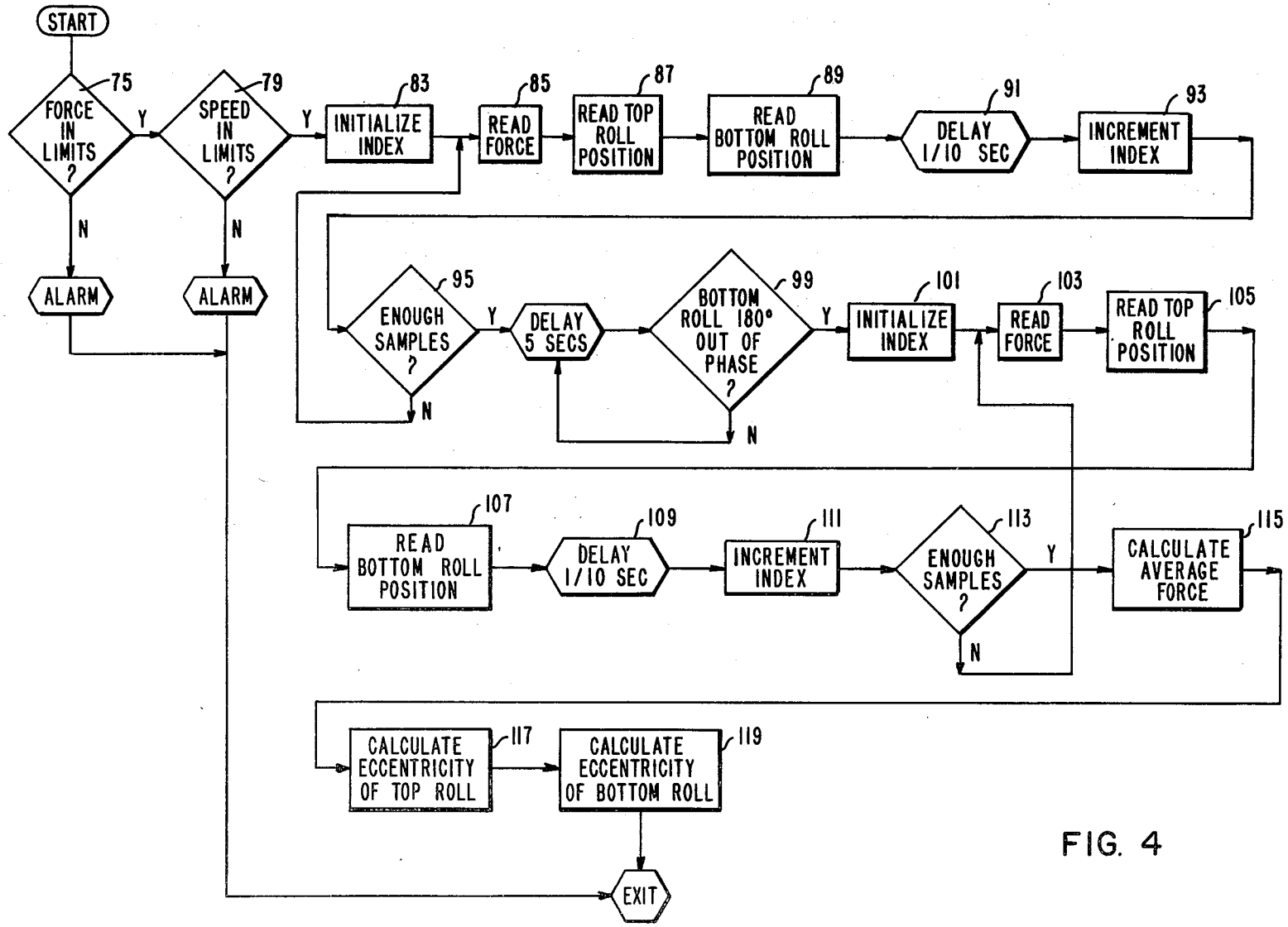
FIG. 4 shows a logic flow chart to illustrate the operation of the back-up roll eccentricity measurement program operative with the gauge control system shown in FIG. 1.

In FIG. 4 there is shown a flow chart to illustrate the eccentricity measurement program operation for the back-up roll eccentricity determination. At step 75 the roll stand force is read and checked in relation to predetermined limits, such as high limit of 1500 metric tons and a low limit of 800 metric tons, and if the force reading is outside of those limits at step 77 an alarm is provided for the operator and the program ends. If the stand roll force reading is within the desired limits, at step 79 the roll stand speed is read and checked in relation to predetermined limits, such as a high limit of 100 RPM and a low limit of 50 RPM, and if the speed is outside of those limits at step 81 an alarm is provided for the operator and the program ends. If the roll stand speed is within the desired limits, at step 83 the eccentricity index is initialized and a program loop is begun at step 85 where the stand roll force is read as the work rolls are rotating. In practice the program operation is such that 90 force sample readings will be taken during one back-up roll rotation. At step 87 the angular position of the top back-up roll is read from the rotatary transducer 44, and 90 such readings will be taken or one reading every 4° of rotation. At step 89 the angular position of the bottom back-up roll is read from the rotary transducer 46, and 90 such readings will be taken. At step 91 the position readings are stored in memory and a delay of about one-tenth second is provided, and at step 93 the index is incremented such that the next force and position sample readings are taken the next time through this loop. At step 95 a check is made to see if 90 sample readings have been taken, and if not the program loops back to step 85 and if so the program goes to step 97 for a delay of 5 seconds to wait until the bottom back-up roll has rotated 180° in relation to the top back-up roll. At step 99 a check is made to see if the bottom back-up roll is 180° out of phase in relation to the top back-up roll, and if not the program loops back to step 97 for another time delay of 5 seconds and then another check is made at step 99 until the 180° out-of-phase condition has occurred. If the check at step 99 shows that the bottom back-up roll is 180° out of phase, the program goes to step 101 to initialize the 180° out-of-phase eccentricity index. At step 103 the stand roll force is read as the work rolls are rotating. Again, 90 force sample readings are taken during one back-up roll rotation. At step 105 the position of the top back-up roll is read from the rotary transducer 44, and 90 such readings will be taken or one reading every 4° of rotation. At step 107 the position of the bottom back-up roll is read from the rotary transducer 46, and 90 such readings will be taken. At step 109 the position readings are stored in memory and a delay of about one-tenth second is provided, and at step 111 the index is incremented such that the next force and position sample readings are taken the next time through this loop. At step 113 a check is made to see if 90 sample readings have been taken, and if not the program loops back to step 103 and if so the program goes to step 115 to calculate the average stand roll force by summing up all force readings taken during the first 90 samples and dividing by the number of such samples. At step 117 the top back-up roll eccentricity $E_T$ is calculated in accordance with the relationship of above equation (18), at step 119 the bottom back-up roll eccentricity $E_B$ is calculated in accordance with above equation (11), and then the program ends.

The above method of measuring the roll eccentricity requires that, once the calibration force level has been established, the cylinder position is then maintained constant and the variations in force are measured as the back-up rolls rotate. An alternate way of performing the eccentricity measurements is to maintain the force constant as the back-up rolls rotate and measure the resulting changes in cylinder position required to compensate for the eccentricity of the rolls. The cylinder position data is collected in the same way that the force data is collected. The top and bottom eccentricity is calculated in the same way as in equations (11) and (18) except the cylinder position data is already in displacement units so multiplication by the mill spring constant K is not required.

FIG. 7 shows such a collection method with cylinder position data measured at 10° increments as the rolls rotate and stored in a data table TAB1. After the bottom roll has rotated 180° with respect to the top roll, cylinder positions are again measured for every 10° of rotation and stored in data table TAB2. Relationship (1) is used to determined the 36 roll eccentricity values that correspond to the angular position of the top back-up roll and these values are stored in table TRE. Relationship (2) is used to calculate the bottom roll eccentricity values that are stored in the data table BRE. The TRE and BRE eccentricity values are used to compensate the gauge error calculations in the constant roll gap control 18.

Figure 5:
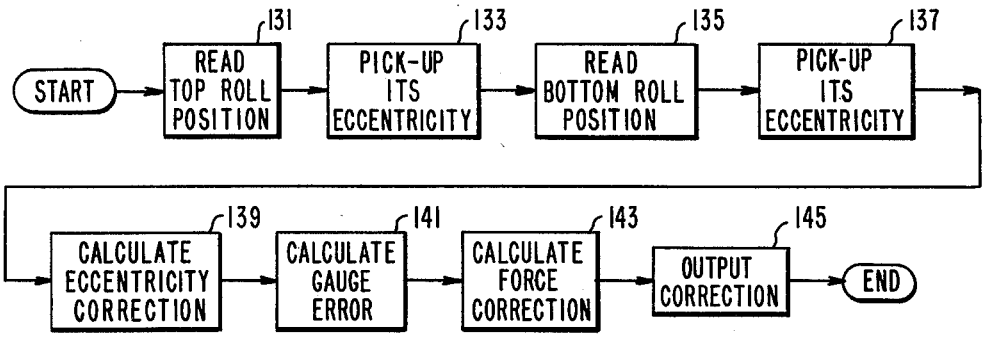
FIG. 5 shows a flow chart to illustrate the operation of the back-up roll eccentricity implementation program operative with the gauge control system shown in FIG. 1.

In FIG. 5 there is shown a flow chart to illustrate the eccentricity measurement system 22 shown in FIG. 1. At step 131 the position of the top back-up roll 28 is read from the rotary transducer 44. At step 133, using the top back-up roll position as an index, the eccentricity $E_T$ value is obtained from the look up table provided by the FIG. 4 program. At step 135 the position of the bottom back-up roll 30 is read from the rotary transducer 46. At step 137, using the bottom back-up roll position as an index, the eccentricity $E_B$ value is obtained from the look up table provided by the FIG. 4 program. At step 139 the eccentricity correction is obtained by adding together the individual eccentricity values, in accordance with the relationship indicated by above equation (19), which is used to calculate the gauge error at step 141. At step 143 the force correction is calculated in accordance with above equation (5), and at step 145 this roll opening correction is output to the roll opening position control 14 shown in FIG. 1.

Figure 6:
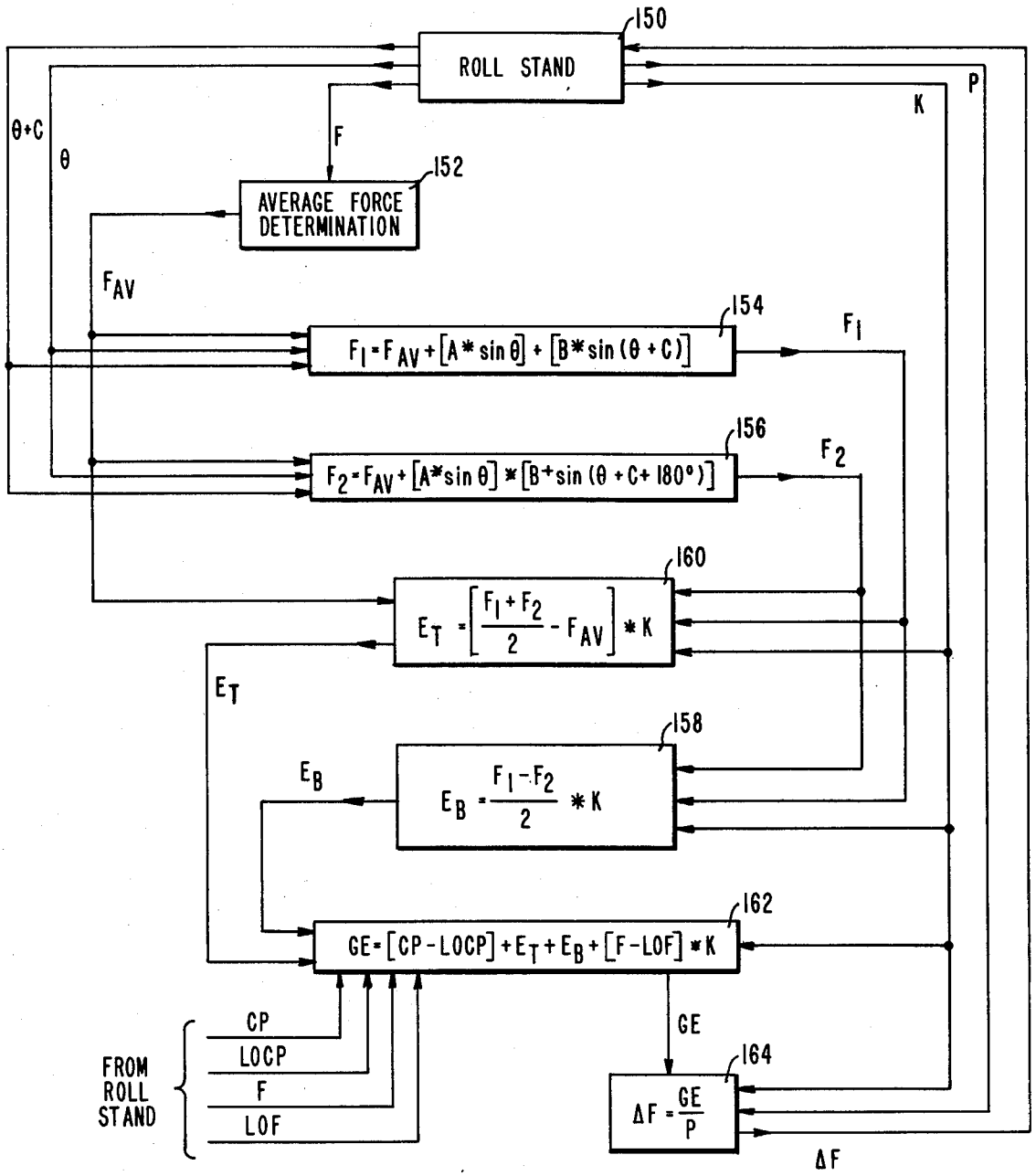
FIG. 6 is a functional illustration of the eccentricity determination and the control of workpiece delivery gauge in accordance with the present invention.

In FIG. 6 there is functionally illustrated the eccentricity determination and the control of workpiece delivery gauge in relation to a roll stand 150. At block 152 the average stand roll force $F_{AV}$ is determined. At block 154 the force reading $F_1$ is established for in the order of every 4° of rotation of the top back-up roll 28 in accordance with above equation (6). At block 156 the force reading $F_2$ is established in accordance with above equation (7). At block 158 the eccentricity $E_B$ of the bottom back-up roll 30 is established in accordance with above equation (11), and at block 160 the eccentricity $E_T$ of the top back-up roll 28 is established in accordance with above equation (18). At block 162 the gauge error including eccentricity is established in accordance with above equation (19), and at block 164 the roll force correction is established in accordance with above equation (5).

OVERALL SUMMARY — OPERATION OF FIG. 1 EMBODIMENT

The overall operation of the system of the invention will now be summarized.

Before beginning rolling operations, and each time the back-up rolls 28 and 30 are changed, the system is calibrated in accordance with the following procedure.

1. The cylinder position (CP) is adjusted so that the work rolls 32, 34 are touching and generating about 1,000 tons roll force; the mill speed is set to some typical rolling speed.

2. The Constant Roll Gap Program in the computer is disabled. In this mode, the computer generates one fixed force reference of approximately 1,000 tons.

3. The computer calibration program scans the cylinder position feedback over one complete revolution of the top back-up roll 28, storing approximately 36 values. The values are stored in table TAB1 (see FIG. 7); the index in the table is a function of the angular position of the back-up roll (see FIG. 7). The 36-cylinder position values are then normalized by calculating their average, subtracting each value from the average, and storing the result back into the table.

4. The computer waits for one back-up roll to rotate 180° C with respect to the other. (This will occur due to roll slippage and slight differences in roll diameters).

5. Step (3) above is now repeated except the cylinder position values are stored in table TAB2.

6. The data collected in steps (3) and (5) is the result of eccentricities in both the top and bottom rolls 28, 30. In order to obtain the component contributed by the top roll only, the data in Tab1(I) is added to TAB2(I), and the result divided by 2:

$$\text{Top Roll Eccentricity} = \text{TRE}(I) = \frac{\text{TAB1}(I) + \text{TAB2}(I)}{2}$$

where I = 1→36 corresponding to the 36 values in the tables.

In effect, the bottom roll component is cancelled out. In order to obtain the component contributed by the bottom roll only, the data in table TRE(I) is subtracted from TAB1(I):

Bottom Roll Eccentricity = BRE(I) = ½ TAB(I) − TRE(I). When tables TRE and BRE are filled, the calibration procedure is complete. The calibration results may be checked by running the mill rolls together, with the Constant Roll Gap Control Program enabled. The observed results should be:

(a) a constant measured roll force RF with little variation; and (b) a varying measured cylinder position (CP) with the magnitude of this variation reflecting the amount of roll eccentricity. When product (workpiece) first enters the mill stand 10, the lock-on roll force (LRF) cylinder position (CP) and back-up roll position ($\phi$) are measured, and the roll gap, defined as the lock-on roll gap (LGAP) is calculated:

$$LGAP = CP + K^*LRF + TRE(I_1) + BRE(I_2) \quad (20)$$

where:

$LGAP$ = lock-on roll gap
$CP$ = measured cylinder position
$K$ = mill spring constant
Units:MILS/TON or MM/TON
$LRF$ = lock-on roll force (measured)
$I_1$ = index calculated from the angular position of the top back-up roll 28 (see FIG. 7)
$I_2$ = index calculated from the angular position of the bottom back-up roll 30 (see FIG. 7)
$TRE$ = table containing values of the top back-up roll eccentricity (see FIG. 7)
$BRE$ = table containing values of the bottom back-up roll eccentricity (see FIG. 7)

The instantaneous roll gap is computed from the generalized equation:

$$GAP = CP + K^*RF + TRE(I_1) + BRE(I_2) \quad (21)$$

where $GAP$ = roll gap, $RF$ = measured roll force and the remaining members of the right hand side of the equation are defined as in equation (20) above.

The gauge error is calculated from the equation:

$$GE = LGAP - GAP \quad (22)$$

where $GE$ = gauge error
$LGAP$ = lock-on roll gap computed from equation (20)
$GAP$ = roll gap calculated from equation (21) using the instantaneous measured roll force Using the gauge error GE calculated from equation (22) above, the constant roll gap system (18, 22) calculates the force reference FREF from the equation:

$$FREF = LRF + (GE/P) \quad (23)$$

where $LRF$ = lock-on roll force
$GE$ = gauge error from equation (22)
$P$ = product plasticity in units MILS/TON or MM/TON The reference signal FREF is applied to change the force reference to force control 16 as required.

In order to better understand the operation of the system, the effects of eccentricity and gauge variation will be independently considered. By superposition principles these several effects can be added to provide the practical dynamic situation where both eccentricity and gauge error may occur simultaneously.

When only eccentricity is involved the force control 16 will move the hydraulic cylinder 38 up and down to maintain constant roll force. Considering now equation (21), the measured cylinder position CP will move up and down, the term K*RF will remain constant, and if the perturbations are due alone to eccentricity, the GAP term will remain one number or be constant. The measured cylinder position CP (feedback) will move up and down to compensate for the terms TRE($I_1$) and BRE($I_2$). Since the roll gap remains constant, the gauge error GE (equation 21) remains the same, and hence, the force reference FREF calculated from equation (22) will remain the same. (As previously indicated the signal FREF is the force reference signal to force control 16 (FIG. 1).

Assume now the second condition, that is, the back-up rolls 28, 30 are perfectly or substantially cylindrical so that the terms TRE($I_1$) and BRE($I_2$) in equation (21) will be zero. Equation 21 then reduces to:

$$GAP = CP + K^*RF \quad (24)$$

In response now to a change in gauge or hardness, i.e., the steel in the roll gap now is colder than that preceding, then the measured cylinder position CP will change in order to maintain constant roll force. This action will change the roll gap GAP. Following this change through equations (22) and (23), this will produce a new force reference FREF which applied to force control 16 will cause the roll force to change.

When the disturbances, i.e., eccentricity and gauge change take place simultaneously, the effects are interactive. The terms TRE($I_1$) and BRE($I_2$) mitigate the effects of eccentricity and keep GAP constant, while a gauge change (resulting from changes in thickness or hardness) tends to produce a new roll force reference FREF to change the roll force, the degree to which the one or the other plays the greater role depends upon the magnitude of the contributory perturbative factor.

We claim:

1. A method for controlling the delivery gauge of a workpiece passing through a rolling mill stand having at least a pair of work rolls and at least a pair of back-up rolls, the work roll pair being in spaced relationship to define a roll gap through which the workpiece passes, the back-up rolls being mounted contiguously with said work rolls and having a spurious eccentricity, said work rolls exerting a roll force on said workpiece, said method comprising the steps of:

(a) measuring and recording the eccentricity magnitudes of said back-up rolls prior to rolling said workpiece;

(b) maintaining a constant roll gap at said work rolls when there is no change in the gauge of said workpiece, by keeping the roll force constant in accordance with a reference roll force, and rapidly bidirectionally displacing said back-up rolls so as to neutralize said measured and recorded eccentricity magnitudes;

(c) maintaining constant roll force assuming substantially no eccentricity of said back-up rolls, by less rapidly bidirectionally displacing said back-up rolls so as to maintain said roll force constant with concomitant change in roll gap, and (d) combining steps (b) and (c) by superposition when eccentricity and gauge changes obtain, so that said concomitant change in roll gap produces a new reference roll force to modify the response of step (b).

2. A method according to claim 1 wherein in step (b) the roll gap is maintained constant in accordance with the equation:

$$GAP = \Delta D + TRE(I_1) + BRE(I_2)$$

where $GAP$ = roll gap $\Delta D$ = incremental displacement of the back-up rolls, and $TRE(I_1)$ and $BRE(I_2)$ are magnitudes obtained for the eccentricity of the upper and bottom back-up rolls obtained respectively from step (a).

3. A method according to claim 1 wherein in step (c) constant roll force is maintained in accordance with the equation:

$$GAP = \Delta D + K^{*}RF$$

where $GAP$ = roll gap $\Delta D$ = the incremental displacement of the back-up rolls $K$ = the mill stand spring constant $RF$ = the roll force.

4. The method according to claim 2 wherein step (b) is performed using analog techniques.

5. The method according to claim 3 wherein step (c) is performed using digital techniques.

6. Apparatus for controlling the delivery gauge of a workpiece passing through a rolling mill stand having at least a pair of work rolls and at least a pair of back-up rolls, the work roll pair in spaced relationship defining a roll gap (GAP) the back-up rolls being mounted contiguously with said work rolls, the back-up rolls having an undesired eccentricity, said rolls exerting a roll force (RF) on said workpiece, comprising:

(a) means for regulating the displacement of said back-up rolls, having first and second inputs and an output, the output providing a signal for bidirectional displacement of said back-up rolls;

(b) means for measuring the instantaneous displacement of said back-up rolls applied to the second input of said displacement regulating means;

(c) means for regulating said roll force, having first and second inputs, and an output connected to the first input of said displacement regulating means;

(d) means for measuring the instantaneous roll force connected to the second input of said roll force regulating means;

(e) means for calculating a roll force reference signal (FREF) which is applied to the first input of said roll force regulating means, said roll force reference signal being a function of the roll gap and of the eccentricity of the back-up rolls.

7. Apparatus according to claim 6 wherein said calculating means calculates the signal FREF in accordance with the equation:

$$FREF = LRF + (GE/P)$$

where $LRF$ = the lock-up roll force $GE$ = the gauge error $P$ = the plasticity of said workpiece and the gauge error GE is calculated according to the equation:

$$GE = \Delta D + (K) \times RF + TRE(I_1) + BRE(I_2)$$

where $\Delta D$ = the displacement of the back-up rolls, $K$ = the mill spring constant, $RF$ = the roll force, $TRE(I_1)$ = the measured magnitudes for the eccentricity of the top back-up roll, and $BRE(I_1)$ = the measured magnitudes for the eccentricity of the bottom back-up roll.

8. Apparatus according to claim 6 wherein said displacement regulating means and said roll force regulating means are analog components, and said calculating means is a digitial computer.

* * * * *